US005678666A

United States Patent [19]

Shyr et al.

[11] Patent Number: 5,678,666

[45] Date of Patent: *Oct. 21, 1997

[54] TRAVELING BAG DETACHABLY HOUSING A PORTABLE COMPUTER

[75] Inventors: Michael H. Shyr; Godfrey S. Shyr, both of Hacienda Heights, Calif.

[73] Assignee: Goodhope Bags, Ind., Inc., La Puente, Calif.

[ * ] Notice: The term of this patent shall not extend beyond the expiration date of Pat. No. 5,474,162.

[21] Appl. No.: 541,934

[22] Filed: Oct. 10, 1995

[51] Int. Cl.[6] ..... A45C 3/00

[52] U.S. Cl. ..... 190/102; 190/108; 190/110

[58] Field of Search ..... 190/108, 109, 190/110, 111, 18 A, 102, 24, 127; 206/305, 320, 579; 150/113

[56] References Cited

U.S. PATENT DOCUMENTS

| | | | |
|---|---|---|---|
| 2,362,807 | 11/1944 | Dresner | 190/110 X |
| 3,977,501 | 8/1976 | Alonso | 190/119 X |
| 4,176,734 | 12/1979 | Wang | 190/127 X |
| 4,260,004 | 4/1981 | Domke | 190/110 X |
| 4,569,082 | 2/1986 | Ainsworth et al. | 150/113 X |
| 5,054,589 | 10/1991 | Bomes et al. | 190/111 X |
| 5,105,920 | 4/1992 | Grebenstein | 190/111 X |
| 5,160,001 | 11/1992 | Marceau | 190/102 |
| 5,228,546 | 7/1993 | Chang et al. | 190/18 A |
| 5,374,073 | 12/1994 | Hung-Hsin | 190/18 A X |
| 5,445,266 | 8/1995 | Prete et al. | 206/305 X |
| 5,474,162 | 12/1995 | Shyr et al. | 190/111 X |
| 5,482,147 | 1/1996 | Wang | 190/18 A X |
| 5,524,754 | 6/1996 | Hollingsworth | 206/305 X |
| 5,524,920 | 6/1996 | Tsai | 190/18 A X |

FOREIGN PATENT DOCUMENTS

| | | | |
|---|---|---|---|
| 428451 | 5/1991 | European Pat. Off. | 150/113 |

OTHER PUBLICATIONS

1993–1994 Catalog pp. 5 & 6, Goodhope Bags Industries, Inc.

1994 Hammaker–Schlemmer Catalog page.

Wall Street Journal Article, "Hot Suitcase Brings Success—and Strength", 1994.

*Primary Examiner*—Allan N. Shoap
*Assistant Examiner*—Christopher J. McDonald
*Attorney, Agent, or Firm*—Price, Gess & Ubell

[57] ABSTRACT

The travelling bag of the present invention includes a body portion having a back wall and a support wall attached thereto. The support wall is formed of a rigid plastic material and extends to the back wall. A lid portion of the travelling bag fits over the body portion to close the travelling bag. A partition separates the body portion into a front compartment and a rear compartment. Clothing and other personal items may be placed into the rear compartment, and a computer case can be detachably connected to the support wall within the front compartment.

23 Claims, 4 Drawing Sheets

TRAVELING BAG DETACHABLY HOUSING A PORTABLE COMPUTER

BACKGROUND OF THE INVENTION

1. Field of the Invention

The present invention relates generally to a travelling bag having partitions and, more particularly, to a travelling bag with separate compartments for carrying both garments and computer equipment.

2. Description of Related Art

Although travelling bags having multiple compartments exist in the prior art, the prior art has not invented a travelling bag for carrying personal items and also a detachably secured computer case. Moreover, the prior art has not invented a travelling bag having a computer case that snugly fits into the travelling bag with tie-down security, and partitions for carrying other computer equipment such as printers, facsimiles, and power cords. Nor has the prior art disclosed these computer equipment partitions in combination with file compartments and organizer pockets for stationery items, disks, calculators, compact disks, pens, key chains, etc.

OBJECTS AND SUMMARY OF THE INVENTION

The travelling bag of the present invention includes a body portion having a back wall and a support wall attached thereto. The support wall is formed of a rigid plastic material and extends to the back wall. A lid portion of the travelling bag fits over the body portion to close the travelling bag. A partition separates the body portion into a front compartment and a rear compartment. Clothing and other personal items may be placed into the rear compartment, and a computer case can be detachably connected to the support wall within the front compartment. The computer case houses a portable computer and is detachably connected to the support wall with Velcro hook and knap material. Other partitioning straps can be placed within the front compartment to securably hold printers, facsimiles, power cords, pointers, etc. Finally, straps can be secured around the computer and computer equipment to securably hold said items in place.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically.

Figure 1:
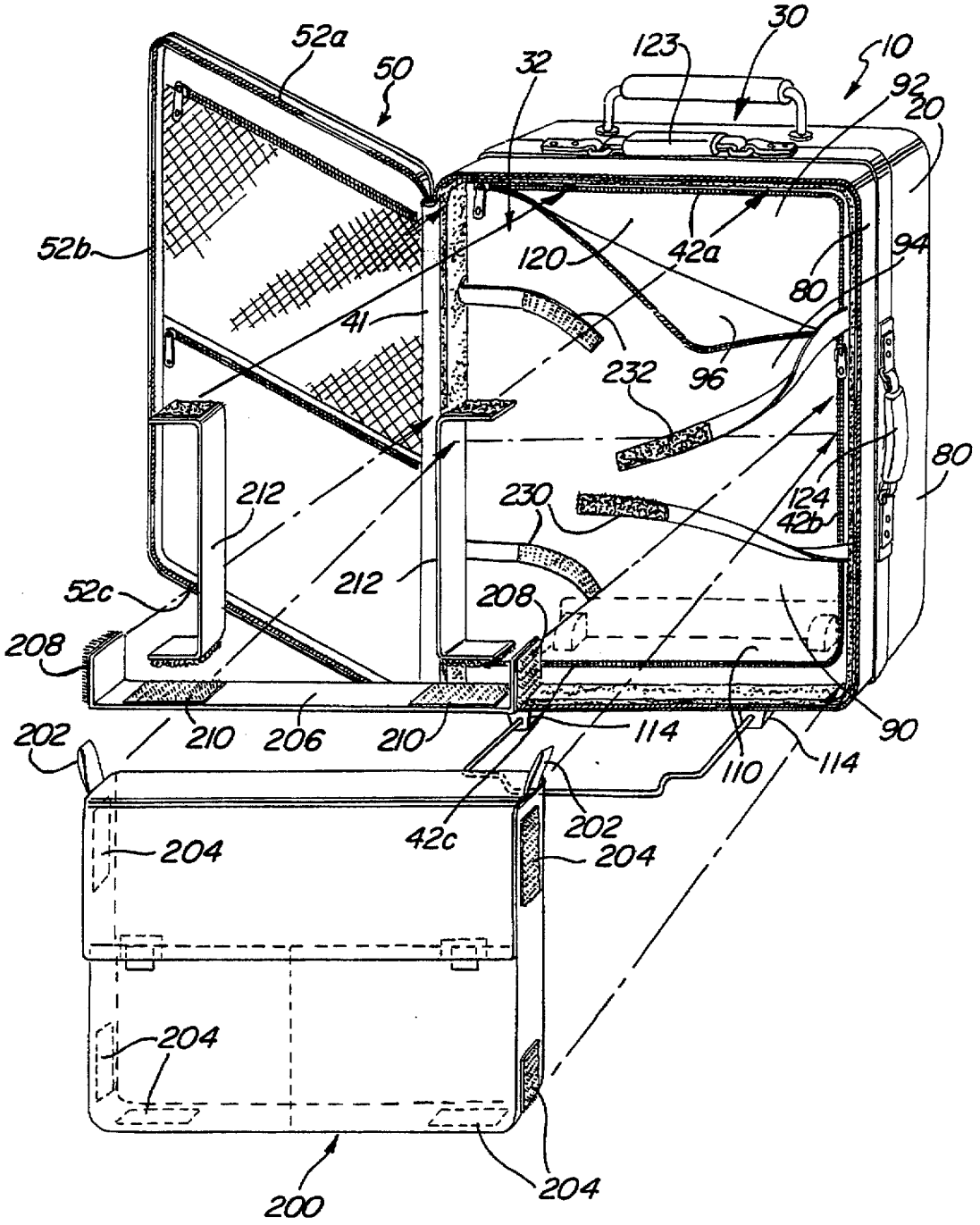
FIG. 1 is a front perspective view of the travelling bag of the presently preferred embodiment in an open position.

The travelling bag 10 of the presently preferred embodiment is shown in FIG. 1 in an opened position. The external covering 20 of the travelling bag 10 is preferably manufactured from a flexible material. In the presently preferred embodiment, the flexible material of the external covering 20 comprises 600D polytex with PVC backing. Alternatively, the external covering 20 may comprise canvas, cloth, leather, nylon, or any combination thereof. In the presently preferred embodiment, the external covering 20 is divided into a body portion 30 and a lid portion 50.

The body portion 30 comprises a back wall 120 and a support wall 80. The space surrounded by the back wall 120 and the support wall 80 generally defines a travelling bag compartment 32. The support wall 80 preferably comprises a semirigid plastic material.

A partition 90, having a size approximately equal to the size of the back wall 120, is secured to the support wall 80. The partition 90 divides the travelling bag compartment into a rear compartment 92 and a front compartment 94.

Garments and other personal items may be placed into the rear compartment 92, and the front compartment may house computer equipment. In a preferred embodiment, a traveller may carry the travelling bag onto an aircraft, for example, and access the computer equipment while using the partition 90 to shield his or her personal items in the rear compartment from public view.

The partition 90 preferably comprises a flexible material having high tensile strength and includes a zippered flat portion 96. The zippered flat portion 96 provides convenient access to the rear compartment 92 without having to detach the partition 90 from the body portion 30. The partition 90 is preferably tautly drawn across the travelling bag compartment 32, thereby providing structural support for the travelling bag 10. Structural support is provided to the travelling bag 10 by the support wall 80, the partition 90, and a base plate 110 (see FIG. 4).

Figure 3A:
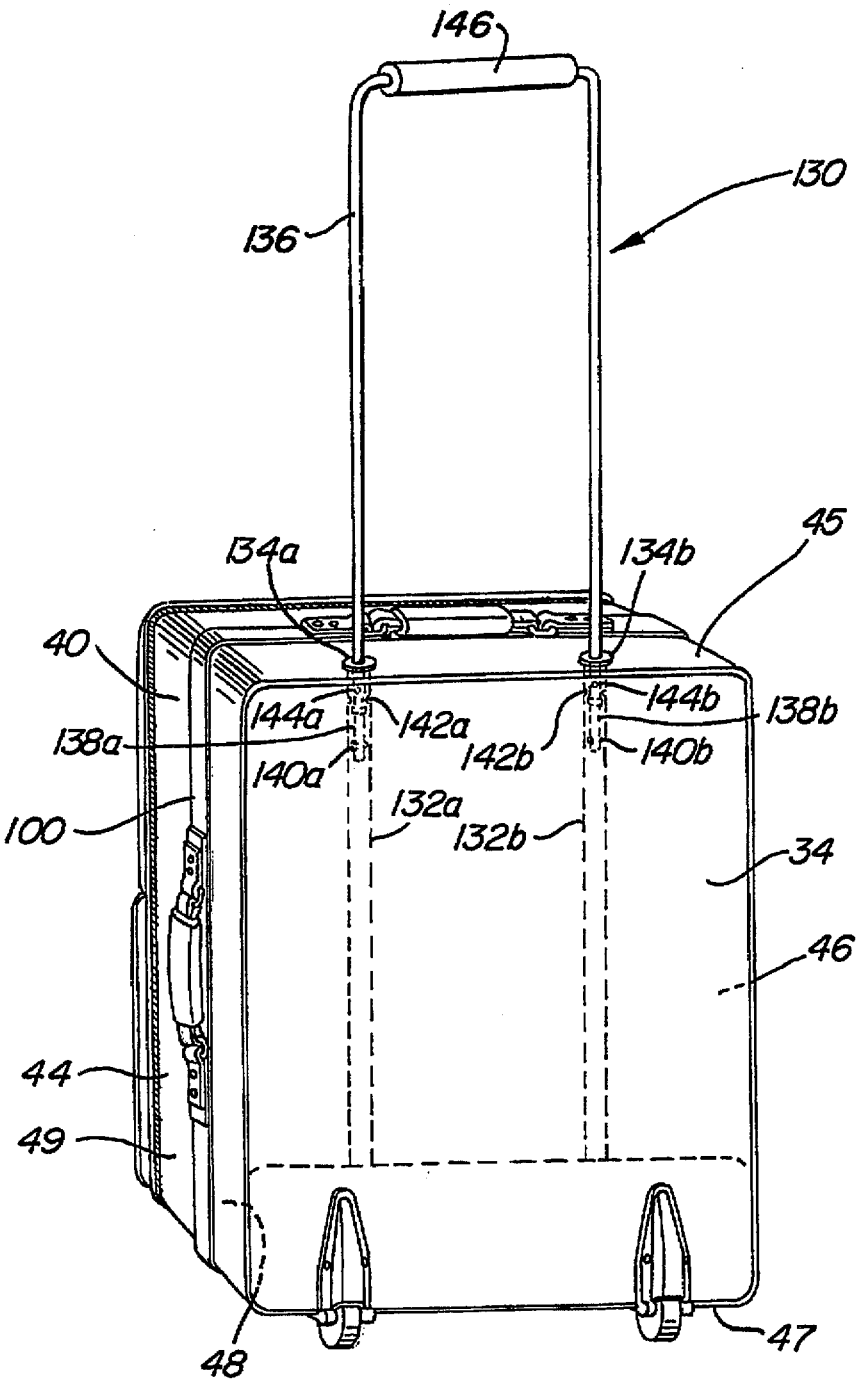
FIG. 3*a* is a rear perspective view of the travelling bag of the presently preferred embodiment in a closed position.

The adjoining perimeter wall 40 of the body portion 30 comprises a perimeter wall interior surface 48 and a perimeter wall exterior surface 49 (FIG. 3*a*). The perimeter wall interior surface 48 includes a left side 44, a top side 45, a right side 46, and a bottom side 47. The perimeter wall 40 of the external covering 20 fits around the support wall 80, the partition 90, and the base plate 110. The base plate 110 fits into the external covering 20 and is attached to the bottom side 47 of the perimeter wall 40. Similarly, the support wall 80 fits into the external covering 20 and is attached to the left side 44, the top side 45, and the right side 46 of the perimeter wall interior surface 48.

The perimeter wall 40 of the body portion 30 comprises a hinge edge 41 and a plurality of zippered edges 42*a*, 42*b*, and 42*c*. The hinge edge 41 pivotally connects the body portion 30 to the lid portion 50. Zippered edges 52*a*, 52*b*, and 52*c* of the lid portion 50 can be respectively attached to the zippered edges 42*a*, 42*b*, and 42*c* of the body portion 30.

As previously mentioned, the zippered flap portion 96 may be closed to secure the clothing and other personal items within the rear compartment 92. Alternatively, the zippered flap portion 96 may be left open, resulting in a single large volume for packing purposes.

According to the presently preferred embodiment, a computer case 200 comprising a flexible polytex material, for example, fits into the front compartment 94. The computer case 200 preferably comprises padding for protecting a portable computer therein. Additionally, the computer case 200 comprises strap-accommodating rings 202 for securing a shoulder strap (not shown) to the computer case 200. Alternatively, a handle or other carrying means may be attached to the computer case 200 for carrying the computer case 200 without the travelling bag 10.

The computer case 200 comprises means for detachably securing the computer case to the perimeter wall interior surface 48 to thereby securely hold the computer case 200 within the front compartment 94. As embodied herein, the securing means comprises VELCRO pads 204.

Figure 2:
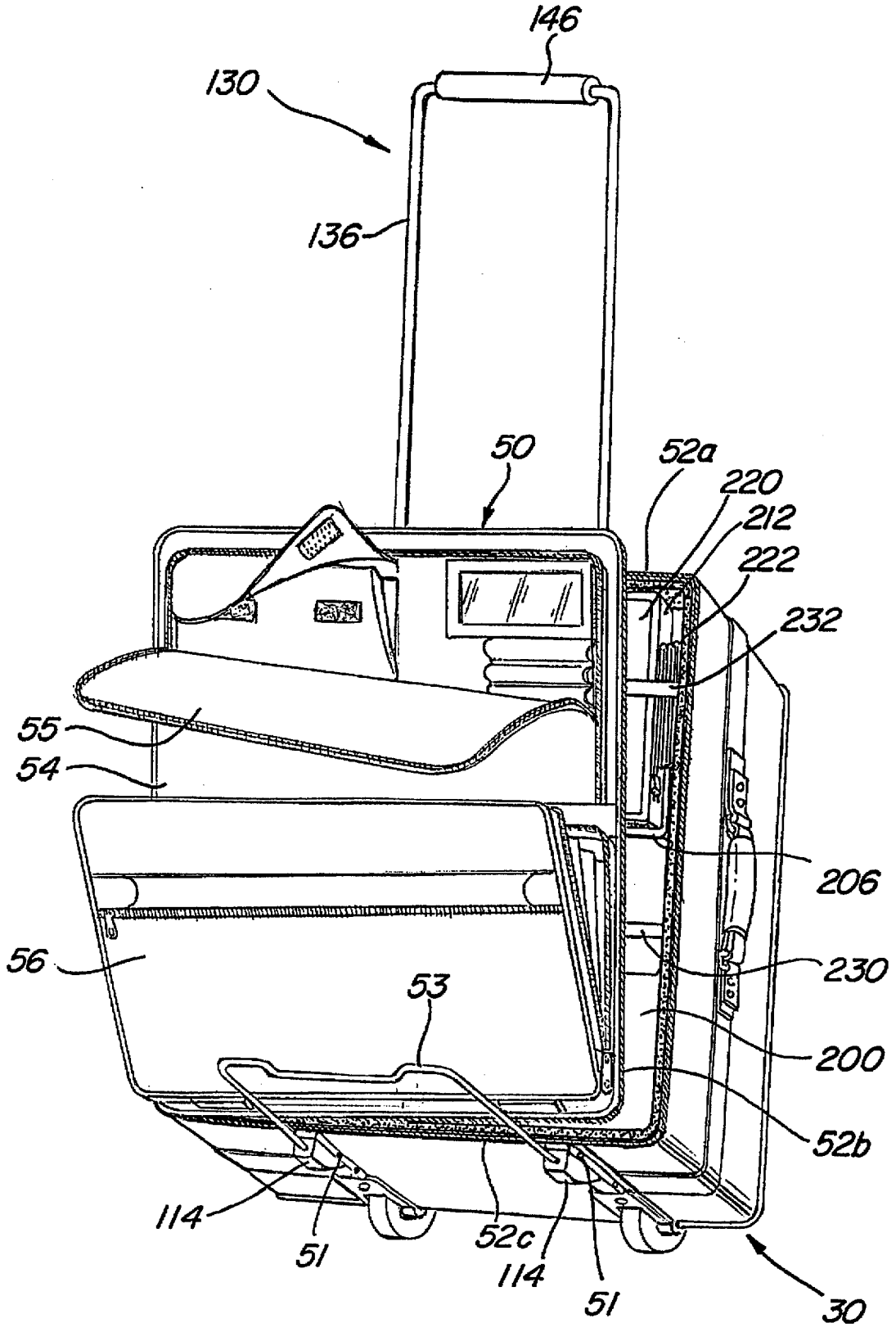
FIG. 2 is another perspective view of the travelling bag of the presently preferred embodiment in an upright and slightly open position.

A primary partition strap 206 comprises VELCRO 208 for attaching to the perimeter wall interior surface 48, and further comprises Velcro™ pads 210 for accommodating one or more supplemental partition straps 212. As shown in FIG. 2, the primary partition strap 206 fastens to opposing sides of the perimeter wall interior surface 48 to thereby snugly hold the computer case 200 in contact with the left side 44, right side 46, and bottom side 47.

One of the supplemental partition straps 212 is secured to a VELCRO pad 210 of the primary partition strap 206 and to the interior top surface of the perimeter wall interior surface 48. This supplemental partition strap 212 partitions the remaining front compartment 94 into a first area for holding a printer 220 and a second area for holding a power cord 222. One or more of the supplemental partition straps 212 and the primary partition strap 206 may be configured differently to accommodate different items, according to preference. Straps 230 and 232 (FIG. 2) can be wrapped around the computer case 200 and the printer 220, respectively, to securely hold said items within the front compartment 94. The partition 90 protects the user's personal items in the rear compartment 92 from contact with the computer items in the front compartment 94.

The lid portion 50, when attached to the body portion 30, provides further support to the computer components in the front compartment 94. The outer surface 54 (FIG. 2) of the lid portion 50 comprises a bottom pocket 56 having file compartments therein and a top pocket 55 having organizer pockets for stationery items, disks, calculators, compact disks, pens, key chains, etc.

Figure 3B:
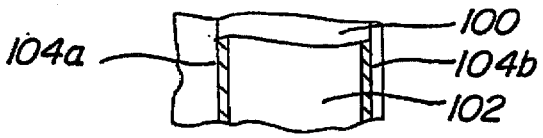
FIG. 3*b* is a partial view of the support band of the travelling bag of the presently preferred embodiment.

Specifically, the inside surface 57 (FIG. 2) of the lid portion 50 contacts the computer equipment. The perimeter support band 100 shown in FIG. 3*a* provides additional structural support to the travelling bag 10. This perimeter support band 100 fits within the travelling bag compartment 32 and provides support to the perimeter wall 40. The perimeter support band 100 preferably comprises a rigid plastic material 102 including two parallel rigid metallic members 104*a* and 104*b* (FIG. 3*b*). In addition to providing structural support to the perimeter wall 40, the perimeter support band 100 secures the partition 90 tautly across the travelling bag compartment 32. The partition 90 is thus secured within the body portion 30 between the support wall 40 and the perimeter support band 100 at the left side 44, the right side 46, and the top side 45 of the perimeter wall 40. The partition 90 is secured at the bottom side 47 between the base plate 110 and the perimeter support band 100.

The partition 90 protects computer components in the front compartment 94 from damaging items in the rear compartment 92, as well as protecting personal items in the rear compartment 92 from computer components in the front compartment 94. When the partition 90 is tautly drawn, it prevents compression of the travelling bag 10 when a compressive force is applied to a corner of the travelling bag 10. For example, a compressive force applied to a corner of the body portion 30 results in expansive forces being applied to the support wall 80. By virtue of the high tensile strength and the taut partitioning of the travelling bag compartment 32, the partition 90 prevents an expansion of the travelling bag 10. In response to the expansive forces, the partition 90 creates retractive forces, which counteract any diagonal expansion of the travelling bag 10 resulting from the compressive force.

Moreover, a force exerted by an object in either the front compartment 94 or the rear compartment 92 is distributed by the partition 90 so that this force is attenuated before application to an item in the compartment opposite the source of the force. For example, when the travelling bag 10 is rotated to place the outside surface 54 of the lid portion 50 on the ground, a force exerted by a sharp, heavy object in the rear compartment 92 does not exert as much force on a computer component in the front compartment 94, since this force is somewhat distributed by the partition 90.

The extendable handle assembly 130 (FIG. 3*a*) is attached to the base plate 110. This extendable handle assembly 130 extends through the rear compartment 92, traversing the body portion 30 through the top side 45 of the perimeter wall 40. In the presently preferred embodiment, the handle assembly 130 includes two receiving tubes 132*a* and 132*b*. Two rubber grommets 134*a* and 134*b* secure the two receiving tubes 132*a* and 132*b* to the perimeter wall 40. A U-shaped member 136 slidably fits into the two receiving tubes 132*a* and 132*b*. Padding 146 on the U-shaped member 136 provides for a comfortable gripping by a user.

Rubber pegs 140*a* and 140*b* fit into holes drilled through the respective ends of the U-shaped member 136. These rubber pegs 140*a* and 140*b* provide resistance to the sliding movement of the U-shaped member 136 within the two receiving tubes 132*a* and 132*b*. A user may thus extend the U-shaped member 136 within the receiving tubes 132*a* and 132*b* to any of a plurality of desired extensions to allow for easy pushing or pulling of the travelling bag 10 while maintaining the selected telescopic extension of the U-shaped member 136. Circumferential crimps 142*a* and 142*b* in the two receiving tubes 132*a* and 132*b* prevent the U-shaped member 136 from sliding out of the receiving tubes 132*a* and 132*b*. These circumferential crimps 142*a* and 142*b* operate to decrease the effective inner diameter of the receiving tubes 132*a* and 132*b* to prevent the rubber pegs 140*a* and 140*b* from sliding out of the receiving tubes 132*a* and 132*b* at a maximum selected telescopic extension of the U-shaped member 136. Two depressions or fossa 144*a* and 144*b* prevent the rubber grommets 134*a* and 134*b* from sliding out of the receiving tubes 132*a* and 132*b*.

The two rubber grommets 134*a* and 134*b* are positioned on the top side adjacent to the back wall 34 so that the amount of storage space lost in the rear compartment 92 is minimized. The two receiving tubes 132*a* and 132*b* comprising a rigid metallic material provide additional structural support to the travelling bag 10. These two receiving tubes 132*a* and 132*b* may be bolted, welded, or otherwise attached to the base plate 110. The thin, lightweight back wall 120 shields articles in the rear compartment 92 from the extendable handle assembly 130. This thin, lightweight back wall 120 may be glued or otherwise attached to the extendable handle assembly 130.

Figure 4:
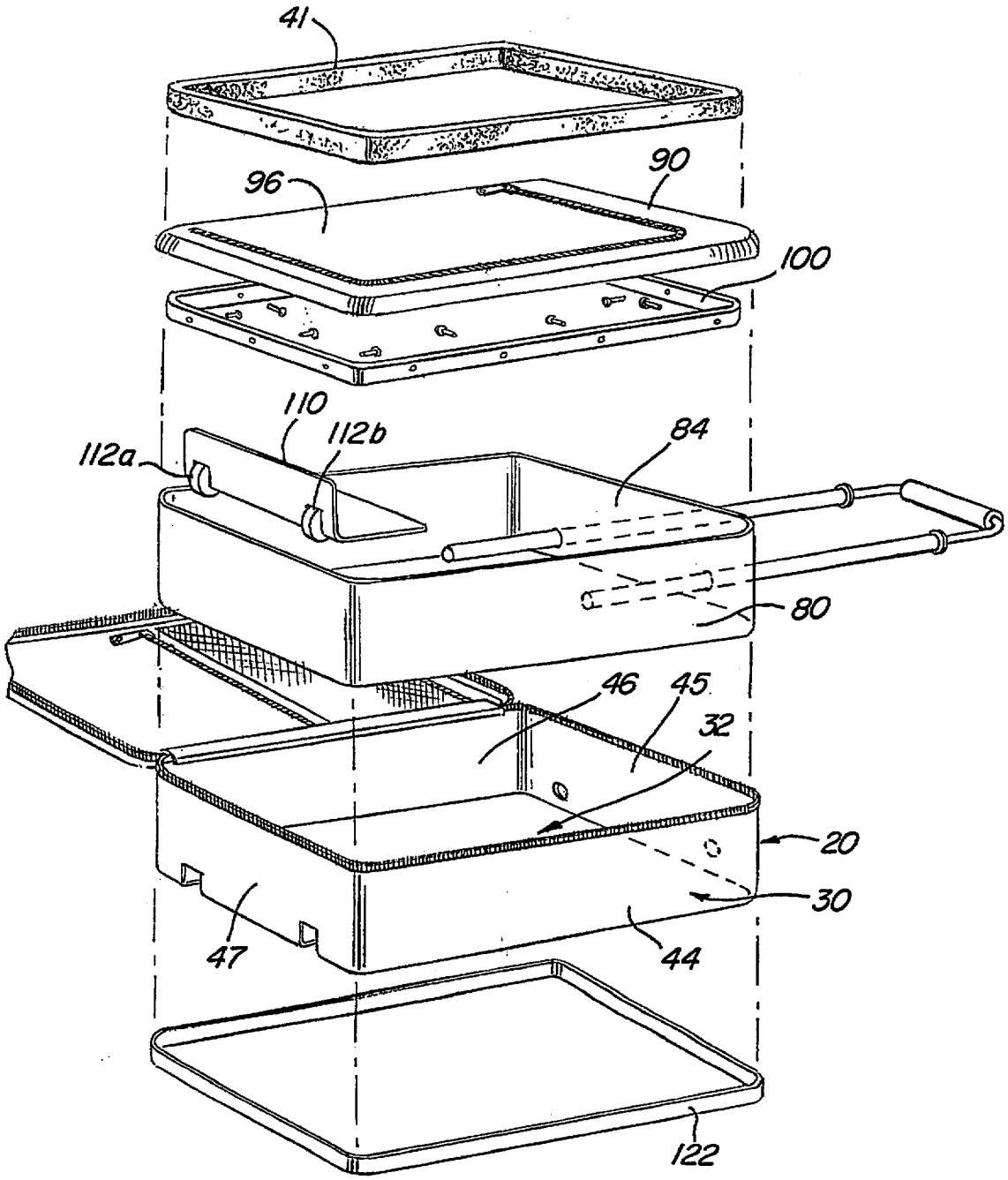
FIG. 4 is an exploded view of the travelling bag of the presently preferred embodiment.

Referring to FIG. 4, an exploded view of the travelling bag 10 of the presently preferred embodiment will now be described. The two wheel assemblies 112*a* and 112*b* and the support wall 80 are all secured to the base plate 110. This entire assembly is then fitted into the body portion 30 of the exterior covering 20. The partition 90 is then stretched over the perimeter support band 100. The partition 90 and the perimeter support band 100 are then placed into the travel bag compartment 32. A ring of Velcro material 43 is also placed into the travelling bag compartment 32. The ring of Velcro material accommodates the computer case 200 and the primary and supplemental portion straps 200 and 212, respectively. The perimeter support band 100 holds the tautly-drawn partition 90 in place across the travelling bag compartment 32 to thereby partition the travelling bag compartment 32 into the rear compartment 92 and the front compartment 94.

In the presently preferred embodiment, the partition 90 is secured between the support wall 80 and the perimeter support band 100 on the left side 44 and the right side 46. Similarly, the partition 90 is secured between the top support plate 84 and the perimeter support band 100 on the top side 45 and between the base plate 110 and the perimeter support band 100 on the bottom side 47.

The perimeter support band 100 is then secured into place around the perimeter wall 40 by riveting, bolts, or other securing means. The decorative strip 122 is placed around the body portion 30 using rivets or bolts. In the presently preferred embodiment, the top handle 123 and the side handle 124 (FIG. 1) are attached to the body portion 30 along the decorative strip 122. Two feet 114 (FIG. 2) are attached to the outside of the bottom side 47 for additional stability. The two feet 114 are secured to the travelling bag 10 with rivets 51. Each foot 114 preferably comprises a plastic tube for accommodating a solid wire 53. The solid wire 53 can be pushed into the two feet 114, and pulled out as shown for added stability to the travelling bag 10. In the presently preferred embodiment, the two feet 114 and a central portion of the solid wire 53 have the same vertical height as the two wheels for securely holding the travelling bag 10 upright.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A travelling bag having partitions for carrying portable computers, garments, and other personal items, comprising:

a body portion including a back wall and a support wall, the support wall being connected to the back wall along a back-wall perimeter of the back wall and extending from the back wall, the body portion being configured to store garments and personal items;

a base plate secured to the support wall, the base plate having two wheels attached thereto;

a lid portion having an inside surface, the inside surface having an inside-surface perimeter, which is similar in size to a perimeter of the support wall;

a hinge edge connecting the body portion to the lid portion along hinge sections of the support wall perimeter and the inside-surface perimeter;

zipper edges positioned along both the support wall perimeter and the inside-surface perimeter, the zipper edges not being positioned along the hinge sections of the respective support wall perimeter and the inside-surface perimeter, the zipper edges and the hinge edge pivotally securing the lid portion to the body portion;

a partition having a partition perimeter, which is similar in size to the backwall perimeter, the partition perimeter being secured to the support wall and dividing the body portion into a front compartment and a rear compartment;

a computer case detachably secured to the body portion, the computer case capable of holding a portable computer either within the body portion or outside of the body portion; and a removable partition strap is connected between two opposing sides of the support wall and with the support wall defines a compartment in the body portion for supporting a computer case.

2. The travelling bag of claim 1, wherein the computer case is detachably secured to the support wall.

3. The travelling bag of claim 2, wherein the computer case is detachably secured to the support wall to hold a portable computer within the front compartment, and has a top surface, a bottom surface, and a rectangular perimeter comprising four sides.

4. The travelling bag of claim 3, wherein a first two opposing sides of the rectangular perimeter are detachably secured to a first two opposing sides of the support wall.

5. The travelling bag of claim 4, wherein the first two opposing sides of the rectangular perimeter are detachably secured to the first two opposing sides of the support wall with securing means.

6. The travelling bag of claim 5, wherein a third side of the rectangular perimeter contacts a third side of the support wall.

7. The travelling bag of claim 1, wherein the bottom surface of the computer case contacts the partition the body portion.

8. The travelling bag of claim 7 wherein the top surface of the computer case contacts the inside surface of the lid portion.

9. The travelling bag of claim 3, wherein the partition strap is detachably connected to the rectangular perimeter with securing means.

10. The travelling bag of claim 1, further comprising a support band secured to the support wall, the support band having a perimeter similar in size to the back-wall perimeter.

11. The travelling bag of claim 10, wherein the partition is secured between the support wall and the support band, and wherein the partition provides structural support to the travelling bag.

12. The travelling bag of claim 11, wherein the partition comprises a zippered flap portion for providing access to the rear compartment without detaching the partition from the body portion.

13. A travelling bag comprising:

a body portion comprising a back wall and a support wall, the support wall being connected to the back wall along a back-wall perimeter of the back wall and extending from the back wall;

a movable partition dividing the body portion into a front compartment and a rear compartment;

a lid portion having an inside surface, the inside surface having an inside-surface perimeter, which is similar in size to a perimeter of the support wall;

a hinge edge pivotally connecting the body portion to the lid portion along hinge sections of the support wall perimeter and the inside-surface perimeter; and a computer case detachably secured to the support wall, the computer case comprising a top surface, a bottom surface, and a rectangular perimeter comprising four sides, a first two opposing sides of the rectangular perimeter being detachably secured to a first two opposing sides of the support wall, a third side of the rectangular perimeter contacting a third side of the support wall, a fourth side of the rectangular perimeter contacting a partition strap connected between the first two opposing sides of the support wall, a top surface of the computer case contacting the inside surface of the lid portion, and a bottom surface of the computer case contacting the partition.

14. The travelling bag of claim 13, wherein both the first two opposing sides of the rectangular perimeter and the partition strap include securing means.

15. The travelling bag of claim 13, wherein the partition strap is a primary partition strap, and wherein the travelling bag further comprises a supplemental partition strap detachably secured between the primary partition strap and the third side of the support wall.

16. A travelling bag having partitions for efficiently packing portable computers, garments, and other personal items, comprising:

a body portion defined by a back wall and a support wall, the support wall being connected to the back wall along a back-wall perimeter of the back wall and extending perpendicularly from the back wall, the body portion for storing the garments and the personal items;

a support band is attached to the support wall and extends about a perimeter of the support wall;

a base plate connected to the support band;

an extendable handle assembly connected to the support wall, a portion of the extendable handle assembly extending adjacent to the back wall and traversing the body portion, wherein the extendable handle assembly is connected to the support wall through the base plate;

a lid portion having an inside surface, the inside surface having an inside-surface perimeter, which is similar in size to the back-wall perimeter;

a hinge edge connecting the body portion to the lid portion along hinge sections of a support wall perimeter and the outside-surface perimeter;

zipper edges positioned along both the support wall perimeter and the inside-surface perimeter, the zipper edges and the hinge edge pivotally securing the lid portion to the body portion;

a partition having a partition perimeter, which is similar in size to the back-wall perimeter, the partition perimeter being secured to the support wall and dividing the body portion into a front compartment and a rear compartment; and a computer case detachably secured to the body portion, the computer case capable of holding a portable computer either within the body portion or outside of the body portion.

17. The travelling bag of claim 15, wherein the body portion and the lid portion comprise a flexible polytex material, and wherein the support wall comprises a semi-rigid plastic material.

18. The travelling bag of claim 16, wherein the base plate has two wheels attached thereto.

19. A travelling bag having partitions for carrying portable computers, garments, and other personal items, comprising:

a body portion including a back wall and a support wall, the support wall being connected to the back wall along a back-wall perimeter of the back wall and extending from the back wall, the body portion being configured to store garments and personal items;

a base plate secured to the support wall, the base plate having two wheels attached thereto;

a lid portion having an inside surface, the inside surface having an inside-surface perimeter, which is similar in size to a perimeter of the support wall;

a hinge edge connecting the body portion to the lid portion along hinge sections of the support wall perimeter and the inside-surface perimeter;

zipper edges positioned along both the support wall perimeter and the inside-surface perimeter, the zipper edges not being positioned along the hinge sections of the respective support wall perimeter and the inside-surface perimeter, the zipper edges and the hinge edge pivotally securing the lid portion to the body portion;

a partition having a partition perimeter, which is similar in size to the back-wall perimeter, the partition perimeter being secured to the support wall and dividing the body portion into a front compartment and a rear compartment;

a computer case detachably secured to the body portion, the computer case capable of holding a portable computer either within the body portion or outside of the body portion; and a support band secured to the support wall, the support band having a perimeter similar in size to the support wall, wherein the partition is secured between the support wall and the support band and the partition provides structural support to the travelling bag.

20. The travelling bag of claim 19, wherein the partition comprises a zippered flap portion for providing access to the rear compartment without detaching the partition from the body portion.

21. The travelling bag of claim 19 further including a partition strap removably dividing the front compartment.

22. The travelling bag of claim 21, wherein two opposing sides of the rectangular perimeter and the partition strap include securing means.

23. The travelling bag of claim 21, wherein the partition strap is a primary partition strap, and wherein the travelling bag further comprises a supplemental partition strap detachably secured between the primary partition strap and the support wall.

* * * * *